US007857542B2

(12) United States Patent
Burtscher

(10) Patent No.: US 7,857,542 B2
(45) Date of Patent: Dec. 28, 2010

(54) ANCHORING FOR PRE-TENSIONED AND/OR STRESSED TENSILE ELEMENTS

(75) Inventor: Stefan L. Burtscher, Vienna (AT)

(73) Assignee: Austria Wirtschaftsservice Gesellschaft m.b.H., Vienna (AT)

( * ) Notice: Subject to any disclaimer, the term of this patent is extended or adjusted under 35 U.S.C. 154(b) by 71 days.

(21) Appl. No.: 10/596,743

(22) PCT Filed: Dec. 21, 2004

(86) PCT No.: PCT/AT2004/000449

§ 371 (c)(1),
(2), (4) Date: Aug. 15, 2006

(87) PCT Pub. No.: WO2005/061813

PCT Pub. Date: Jul. 7, 2005

(65) Prior Publication Data

US 2007/0221894 A1 Sep. 27, 2007

(30) Foreign Application Priority Data

Dec. 22, 2003 (AT) ..... A 2062/2003

(51) Int. Cl.
*E04C 5/12* (2006.01)
*B25G 3/28* (2006.01)
*F16B 2/14* (2006.01)

(52) U.S. Cl. ..... 403/369; 52/223

(58) Field of Classification Search ..... 403/365, 403/367–370, 372, 409.1; 52/223.1, 223.13, 52/223.14

See application file for complete search history.

(56) References Cited

U.S. PATENT DOCUMENTS

| | | | | |
|---|---|---|---|---|
| 3,393,720 | A * | 7/1968 | Fenlin | 81/20 |
| 4,744,691 | A * | 5/1988 | Thal | 403/374.2 |
| 5,802,788 | A * | 9/1998 | Ozawa et al. | 52/223.13 |

FOREIGN PATENT DOCUMENTS

| | | | |
|---|---|---|---|
| DE | 6601081 | | 4/1969 |
| DE | 2515423 | A1 | 11/1975 |
| DE | 10010564 | C1 | 7/2001 |
| EP | 0197912 | A2 | 2/1986 |
| EP | 0554161 | A1 | 1/1993 |
| EP | 0949389 | A1 | 10/1999 |
| JP | 2003278314 | A * | 10/2003 |
| WO | 95/29308 | A1 | 11/1995 |
| WO | WO 0165023 | A1 * | 9/2001 |

* cited by examiner

*Primary Examiner*—Joshua T Kennedy
(74) *Attorney, Agent, or Firm*—Workman Nydegger

(57) ABSTRACT

An anchorage for at least one pre-tensioned or stressed tensile element, wherein the tensile force is transmittable to an anchor body by one or several wedges, including a wedge-shaped layer which has a modulus of elasticity that is lower than at least one other parts of the anchorage, whereby the greatest thickness of the wedge-shaped layer, measured normal to the longitudinal axis of the tensile element, lies in the region of the anchorage which is near the load. The wedge and/or the anchor body may be formed at least by two wedge-shaped adjacent layers, with at least one of the layers being formed from a material having a lower modulus of elasticity than the material from which the further layer(s) of the wedge and/or of the anchor body is/are formed, and the greatest thickness of the layer is provided in the region near the load.

14 Claims, 3 Drawing Sheets

ANCHORING FOR PRE-TENSIONED AND/OR STRESSED TENSILE ELEMENTS

The invention relates to an anchorage for at least one pre-tensioned or stressed tensile element, wherein the tensile force is transmittable to an anchor body by means of one or several wedges and a wedge-shaped layer has a modulus of elasticity that is lower compared to the other parts of the anchorage, whereby the greatest thickness of the wedge-shaped layer, measured normal to the longitudinal axis of the tensile element, lies in the region of the anchorage which is near the load.

Wedge-anchorages have been used for many years for the pre-tensioning of prestressing steels made of high-strength steel. They are based on a simple principle and can be manufactured with a low expenditure of time and materials. For prestressed concrete constructions, the wedge-anchorage is the most common type of anchorage.

With wedge-anchorages, the force in the tensile element is introduced into the wedges via shearing strains and is passed on from there into the anchor body. Wedges and anchor bodies are in contact via an inclined plane on which the wedges can slide. When the tensile element is loaded, a force of pressure normal to the tensile element is created due to the wedge shape, which force presses the wedges against the tensile element.

Internationally, new types of materials such as fibre composites are increasingly used instead of steel for pre-tensioned or stressed tensile elements such as lamellae, wires, rods or cords. Compared to metallic tensile elements, fibre composites have a very high corrosion resistance and a low weight. A significant disadvantage of fibre composites is their high sensitivity to transverse pressure.

The height of the maximum transmittable shearing strain between the wedge and the tensile element conforms to the contact pressure. The higher the contact pressure, the higher the maximum transmittable shearing strain. The contact pressure produces a transverse pressure in the tensile element. In case of materials which are sensitive to transverse pressure, such as, e.g., fibre composites, the maximum transverse pressure which occurs must not exceed a particular quantity.

In order to activate the shearing strains between the wedge and the tensile element, a minimum amount of slippage is necessary. With a conventional wedge-anchorage, a high contact pressure between the wedge and the tensile element is created in the region near the load, which contact pressure produces there also a high shearing strain which decays quickly and remains almost constant up to the region remote from the load. The sum of the shearing strains along the entire contact surface between the wedge and the tensile element corresponds to the tensile force in the tensile element. The greatest shearing strain occurs at the site of the maximum contact pressure, where also the largest amount of tensile force per surface unit is transmitted. It is a disadvantage that, from the site of the maximum shearing strain to the region remote from the load, the shearing strain can hardly be activated. Another disadvantage of a conventional anchorage is that the maximum contact pressure and the maximum shearing strain have to be relatively low, since materials such as fibre composites fail under low contact pressures or transverse pressures.

In WO 95/29308, a conical casting anchorage for fibre composites is described. The anchor sleeve has a conical cavity. Along the direction of the tensile element, the cavity is filled in sections with a casting compound having different moduli of elasticity. In the section on the region near the load, a casting compound with the lowest modulus of elasticity is inserted. In the subsequent sections up to the region remote from the load, casting materials with ever increasing moduli of elasticity are used. In this way, a more uniform transmission of power from the tensile element to the casting body is achieved. However, the manufacture of these layers is a complex process.

EP 0 197 912 A2 discloses an anchorage for prestressing elements made of high-strength steel, wherein the anchor body is composed of two layers of different materials such as a synthetic material or a soft metal. The layer made of a softer material is designed with a constant thickness across the entire wedge length or with a layer which is variable across the wedge length but has the smallest thickness in the region near the load. If the tensile element is loaded, high transverse pressure peaks occur in the region near the load. Materials sensitive to transverse pressure, such as fibre composites, are unable to withstand these high transverse pressures and hence fail prematurely.

In EP 0 197 912, a further variant is shown according to which two wedges lying one after the other in the longitudinal direction of the tensile element are provided in a one-piece anchor body, wherein the wedge closer to the load is formed by a pressed piece which is softer than the tensile element, said wedge-shaped pressed piece having its greatest thickness in the region near the load. The wedge more remote from the load is designed as an anchor wedge and has its greatest thickness in the region remote from the load so that thereby stress peaks and thus transverse pressure peaks occur at the tensile element.

It is the object of the invention to provide an anchorage wherein the contact pressures and the shearing strains which act upon the tensile element to be anchored are evenly distributed across the clamping length of the tensile element or increase slightly from the region near the load to the region remote from the load and exhibit smaller maximum values for contact pressures and shearing strains than the known embodiments. In addition, the manufacture and installation on site are supposed to be feasible in a significantly simplified manner as compared to a casting anchorage.

Said object is achieved according to the invention in that the wedge and/or the anchor body is/are formed at least by two wedge-shaped adjacent layers, with at least one of the layers being formed from a material having a lower modulus of elasticity than the material from which the further layer(s) of the wedge and/or of the anchor body is/are formed, and the greatest thickness of said layer is provided in the region near the load.

In this way, it is possible to evenly distribute the contact pressure and the shearing strains between the wedge and the tensile element from the region near the load to the region remote from the load or even to cause them to increase slightly. If the ratio of the moduli of elasticity of the layers is sufficiently large, the total stiffness of both layers normal to the longitudinal axis of the tensile element is determined mainly by the layer consisting of a material with a low modulus of elasticity. The thicker the layer with a low modulus of elasticity, the lower the stiffness normal to the longitudinal axis of the tensile element. Therefore, the stiffness normal to the longitudinal axis of the tensile element is lower in the region near the load, where the thickness of the layer with a low modulus of elasticity reaches its maximum, than in the region remote from the load. This lower stiffness in the region near the load of this statically indeterminate system causes a lower maximum contact pressure and thus an even distribution of the contact pressure or a slight increase from the region near the load to the region remote from the load. In this way, it also becomes possible to better activate the shearing strains in the contact area between the tensile element and the wedge across the entire length. The low maximum contact pressure thus achieved prevents the tensile element from being destroyed as a result of the transverse pressure.

Advantageous embodiments of the anchorage according to the invention are characterized in the subclaims.

Below, the invention is illustrated further by way of several exemplary embodiments with reference to the attached drawing.

Therein:

Figure 8:
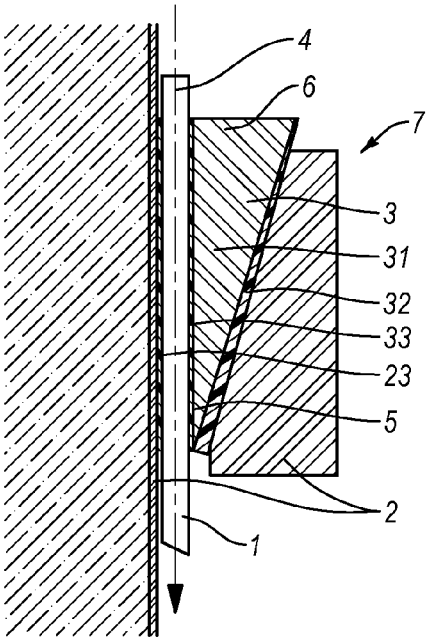
Figure 9:
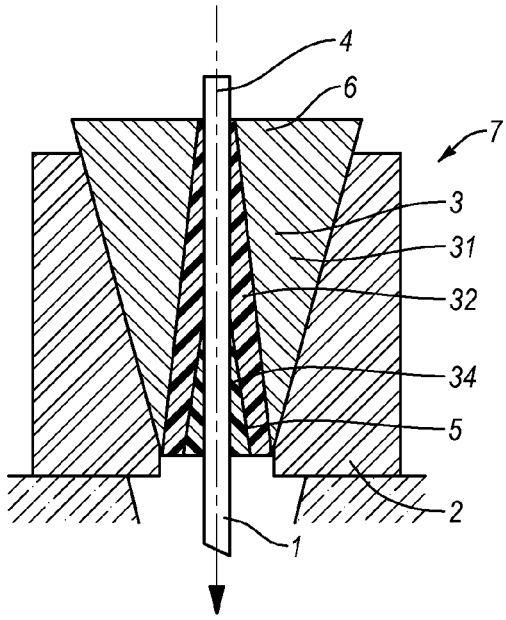
Figure 10:
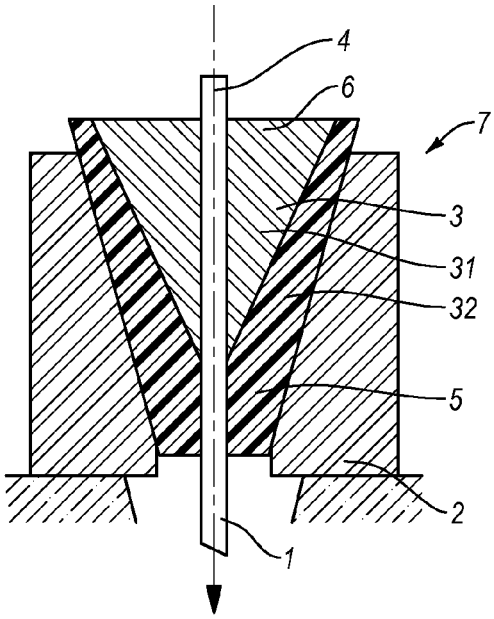
Figure 11:
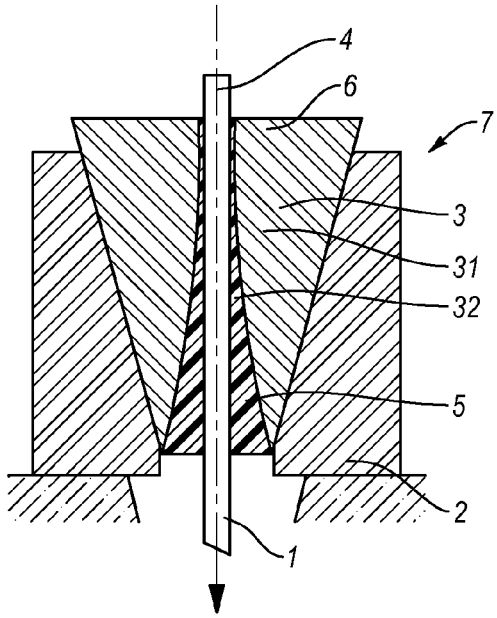

FIG. 8 shows a longitudinal section through an anchorage having an asymmetrical design, consisting of an anchor body, a tensile element and a wedge produced from one layer having a high modulus of elasticity and two layers having a low modulus of elasticity, wherein one layer with a low modulus of elasticity and a variable thickness is arranged near the sliding plane of the wedge and the anchor sleeve, and pressing the tensile element against a plane parallel to the axis of the tensile element, whereby the forces are introduced from the tensile element into the wedge and the parallel plane;

FIG. 9 shows a longitudinal section through an anchorage which is designed with three-layered wedges, wherein two layers with a low modulus of elasticity and a variable thickness exhibit the greatest thickness in the region near the load and only one layer with a low modulus of elasticity is conducted up to the region remote from the load;

FIG. 10 shows a longitudinal section through an anchorage whose wedges are designed with one layer having a low modulus of elasticity and one layer having a high modulus of elasticity, wherein the layer with a low modulus of elasticity and a variable thickness is conducted closer to the region near the load than the layer with a high modulus of elasticity;

FIG. 11 shows a longitudinal section through an anchorage whose wedges are designed with one layer having a low modulus of elasticity and one layer having a high modulus of elasticity, wherein the layer with a low modulus of elasticity tapers toward the region remote from the load according to a curve of a higher order.

Figure 12:
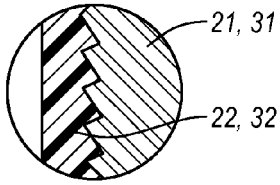

FIG. 12 shows a detail of the anchorage on an enlarged scale.

Figure 1:
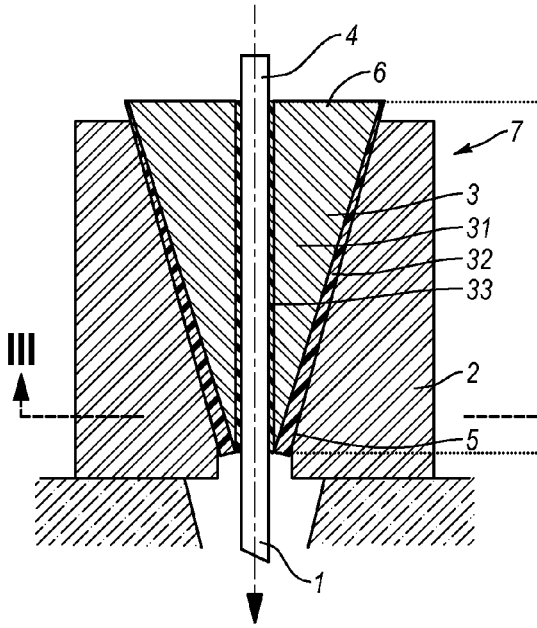
FIG. 1 shows a longitudinal section with an anchor body, a tensile element and two wedges having three layers each, with two layers of the wedge having a low modulus of elasticity and one layer having a high modulus of elasticity, wherein one layer with a low modulus of elasticity and a variable thickness is arranged near the sliding plane between the wedge and the anchor body.
Figure 2:
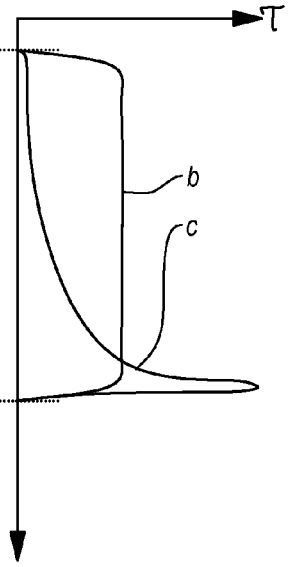
FIG. 2 shows, in chart form, the idealized shearing strain distributions along the contact surface between the wedge and the tensile element for a conventional anchorage and an anchorage according to the invention.

FIG. 1 shows a longitudinal section of the anchorage 7 comprising a wedge 3 formed by two layers 32, 33 having a low modulus of elasticity and one layer 31 having a higher modulus of elasticity. The layers 31, 32, 33 run along the longitudinal axis 4 of the tensile element 1. The layer with a lower modulus of elasticity and a constant thickness 33 is incorporated in order to level out possible stress peaks which might occur due to uneven surfaces or other imperfections. The other layer 32 with a lower modulus of elasticity is arranged close to the anchor body 2 and exhibits its greatest thickness in the region 5 near the load, which decreases toward the region 6 remote from the load. As the thickness of the layer 32 with a lower modulus of elasticity increases, the total stiffness of the wedge 3 decreases normal to the longitudinal axis 4 of the tensile element 1. The contact pressure increases slightly from the region 5 near the load to the region 6 remote from the load, and the entire contact surface between the wedge 3 and the tensile element 1 can be used for the transmission of shearing strains. With conventional wedge-anchorages, large contact pressures and hence also a shearing strain which increases strongly within a short region occur in the region 6 near the load, see line c in FIG. 2. As a result of the contact pressure which is constant from the region 5 near the load to the region 6 remote from the load or which might increase slightly, the shearing strain is distributed more evenly, as illustrated by line b in FIG. 2. In addition, the maximum contact pressure is lower, which is important especially if fibre composites are used. The contact pressure disperses according to the stiffnesses of the layers 31 and 32 and can be varied depending on the ratio of the moduli of elasticity and the layer thicknesses in the region 5 near the load and in the region 6 remote from the load.

Figure 3:
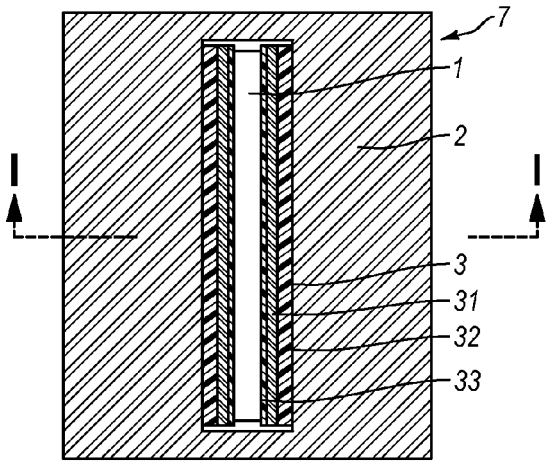
FIG. 3 shows a cross-section taken along intersection line III-III of FIG. 1, wherein the tensile element has a rectangular cross-section and two wedges consisting of three layers each are used.

Section III-III in FIG. 1 is illustrated in FIG. 3 and shows the cross-section of FIG. 1 for the anchorage of a tensile element 1 having a rectangular cross-section and designed as a lamella. Two wedges 3 with flat surfaces are used in said anchorage.

Figure 4:
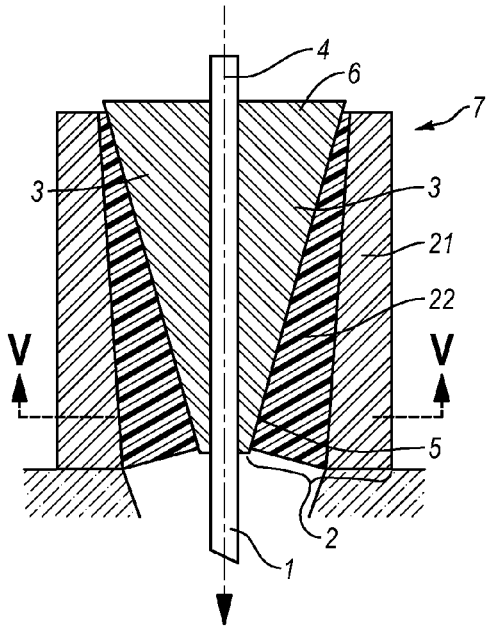
FIG. 4 shows a longitudinal section with an anchor body, a tensile element and two wedges, wherein the anchor body is composed of a layer having a high modulus of elasticity and a layer with a low modulus of elasticity and a variable thickness which is arranged near the sliding plane between the wedge and the anchor sleeve.

The anchorage 7 according to FIG. 4 is based on the same principle as anchorage 7 in FIG. 1, apart from the difference, however, that the wedge 3 has a higher modulus of elasticity whereas the anchor body 2 is composed of one layer 22 with a lower modulus of elasticity which is arranged near the sliding surface and one layer 21 with a higher modulus of elasticity.

Figure 5:
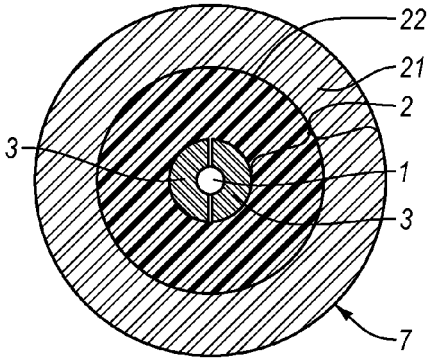
FIG. 5 shows a cross-section taken along intersection line V-V of FIG. 4, wherein the tensile element has a circular cross-section and two wedges without layers and an anchor body comprising two layers are used.

Section V-V in FIG. 4 is illustrated in FIG. 5 and shows the cross-section of FIG. 4 for the anchorage of a wire, a cord or a rod 1. Two wedges 3 supplementing each other and having rounded surfaces are used in said anchorage 7.

Figure 6:
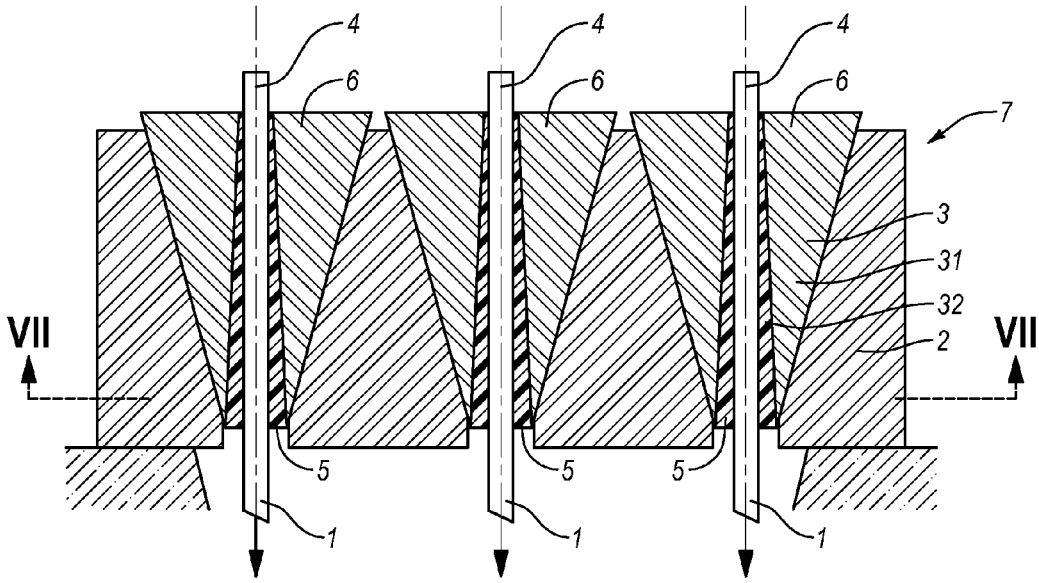
FIG. 6 shows a longitudinal section through an anchorage in which seven wires, rods or cords are anchored and wherein each wedge is composed of a layer having a high modulus of elasticity and a layer with a low modulus of elasticity and a variable thickness which is arranged on the side of the tensile element.
Figure 7:
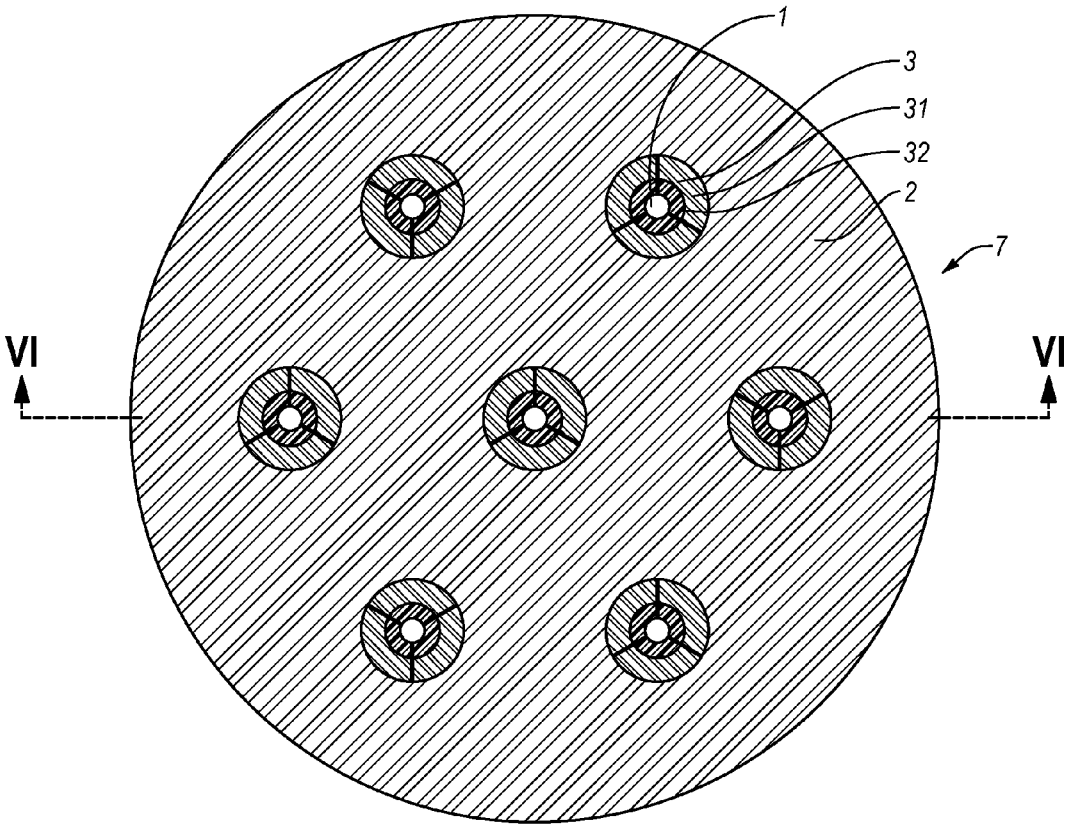
FIG. 7 shows a cross-section taken along intersection line VII-VII of FIG. 6, wherein the tensile element has a circular cross-section and three wedges consisting of two layers are used per each tensile element.

FIG. 6 shows a longitudinal section of an anchorage 7 of seven tensile elements 1. The section taken along line VII-VII is illustrated in FIG. 7 and shows the cross-section of the anchorage 7. Here, each wedge 3 is divided into a layer 32 with a lower modulus of elasticity and a layer 31 with a higher modulus of elasticity. The layer 32 with a lower modulus of elasticity is arranged in the wedge 3 at the clamping element 1 and the layer 31 with the higher modulus of elasticity 31 is arranged near the sliding surface with the anchor body 2. According to FIG. 7, the tensile element 1 is held by three wedges 3 with rounded surfaces.

If lamellae are used as a tensile element 1, it is not always necessary to use several wedges 3 for the anchorage, see FIG. 8. It is also possible to use only one wedge 3 consisting of layers 31, 32, 33 with low and higher moduli of elasticity, which presses lamella 1 against a flat layer 23 lying parallel to lamella 1 and forming part of the anchor body 2. In this case, the wedge 3 is additionally designed with a layer 33 having a lower modulus of elasticity and a constant thickness in order to level out possible stress peaks which might be caused by imperfections. Close to lamella 1, the anchor body 2 likewise comprises a layer 23 with a lower modulus of elasticity and a constant thickness. Said anchorage 7 provides specific advantages for subsequently reinforcing a supporting framework, since the anchorage 7 can be installed at a short distance from the surface of the component and the moment onto the anchorage 7 which arises can be kept small.

The wedge 3 can also be composed of several layers 31, 32, 34 having lower and higher moduli of elasticity 32, 34, as illustrated in FIG. 9, wherein, also in this case, the layers 32, 34 with a lower modulus of elasticity have a greater thickness in the region 5 near the load and not all of these layers are conducted into the region 6 remote from the load.

In FIG. 10, an anchorage 7 is illustrated wherein the wedges 3 are composed of one layer 32 with a lower modulus of elasticity and one layer 31 with a higher modulus of elasticity. Here, the distinctive feature is that the layer 32 with a lower modulus of elasticity has its greatest thickness in the region of the layer 31 with a higher modulus of elasticity which is near the load but is conducted further in order to be able to better initiate the transmission of force and stresses occurring due to vibrations.

In FIG. 11, an anchorage 7 comprising a wedge 3 consisting of a layer 32 with a lower modulus of elasticity and a layer 31 with a higher modulus of elasticity is shown, wherein, in order to better adjust the contact pressure, the thickness of the layer 32 with a lower modulus of elasticity does not change in a linear manner but according to a curve of a higher order.

The layers 32, 33, 34, 22, 23 made of a material with a lower modulus of elasticity can also be prepared by geometrical adjustments such as pores, holes, cavities or other recesses.

The layers 32, 33, 34, 22, 23 having lower and higher moduli of elasticity 21, 31 can be achieved in an anchor body 2 or in a wedge 3 during manufacture by means of a specific treatment such as, for instance, by heating or cooling processes. In this way, it is possible to produce layers with a variable modulus of elasticity which exhibit the same modulus of elasticity along the longitudinal axis 4 of the tensile element 1 and the greatest thickness in the region 5 near the load.

The design with a wedge 3 consisting of at least one layer 32 with a lower modulus of elasticity and one layer 31 with a higher modulus of elasticity or with an anchor body 2 consisting of at least one layer 22 with a lower modulus of elasticity and one layer 21 with a higher modulus of elasticity can be used in combination with each other. Likewise, the layers with a lower modulus of elasticity can be supplemented with or replaced by geometrical adjustments such as pores, holes, cavities or other recesses.

The manufacture of an anchorage 7 of a tensile element 1, formed by a CFK-lamella 1 which usually has a modulus of elasticity of between 165000 and 300000 N/mm$^2$, a strength of between 1500 and 3500 N/mm$^2$ and a thickness of from 0.5 to 2.0 mm, as illustrated in FIG. 1, will now be described by way of example. The layers 32, 33 having a lower modulus of elasticity are manufactured from a synthetic material with a modulus of elasticity of 5800 N/mm$^2$, and the layer 31 having a higher modulus of elasticity and the anchor body 2 are produced from steel with a modulus of elasticity of 210000 N/mm$^2$. The sliding plane encloses an angle of 15° with the longitudinal axis 4 of the tensile element 1, and the wedge length, measured parallel to the tensile element 1, amounts to 80 mm. The layer 32 having a lower modulus of elasticity has a thickness of 4 mm in the region 5 near the load and a thickness of 2 mm in the region 6 remote from the load. Thereby, the thickness of the layer 32 is always measured normal to the longitudinal axis 4 of the tensile element 1. Upon achieving the strength in the tensile element 1, a contact pressure develops in the contact surface between the tensile element 1 and the wedge 3, which contact pressure increases from the region 5 near the load to the region 6 remote from the load from approx. 80 N/mm$^2$ to 100 N/mm$^2$ without any local stress peaks. The shearing strains are evenly distributed, exhibit no local peaks and—for a coefficient of friction of 0.3—produce a maximum value of approx. 45 N/mm$^2$. CFK-lamellae 1 can by all means withstand higher contact pressures and shearing strains, which is why a failure of the tensile element can no longer occur anywhere else than in the free length.

Steel can be used for the layer 31 of the wedge 3 with a higher modulus of elasticity, and epoxy resin can be used for the layer 32, 33 having a lower modulus of elasticity. The modulus of elasticity of steel amounts to 210000 N/mm$^2$ and that of epoxy resin amounts to approx. 5800 N/mm$^2$. The production of a wedge 3 as illustrated in FIG. 6 can take place in a casing. To enable easy removal of the casing after the curing of the epoxy resin, it is advisable to produce the former from Teflon. First of all, the layer 31 of steel must be milled and is secured in the casing prior to casting. In order to prevent air pockets from forming during casting, it is suitable to cast the epoxy resin from below to the top. For this purpose, the epoxy resin can be pressed in under positive pressure through an opening located at the bottom of the casing. After curing and removal of the casing, a double-layered wedge 3 according to the invention is obtained.

Instead of steal and epoxy resin, other materials can also be used, thereby, it is important only that the difference between a higher and a lower modulus of elasticity is large enough.

The higher modulus of elasticity must be at least twice as high as the lower modulus of elasticity, suitably, it is between 20 and 30 times higher.

With epoxy resins, the modulus of elasticity can be increased by more than double by the addition of filling materials such as balls of $Al_2O_3$ having diameters of between 0.5 and 3 mm. Thus, it is possible to use the same epoxy resin but with $Al_2O_3$-balls for the layer 22, 32 with a lower modulus of elasticity which is made of epoxy resin and for the layer 21, 31 with a higher modulus of elasticity.

Wedges 3 for tensile elements 1 designed as lamellae have no curved surfaces. They can be produced in a casing by casting or mechanically by means of an extruder. This works in such a way that the cross-section of the wedge 3 comprising the layers 21, 22, 31, 32, 33, 34 with a lower and a higher modulus of elasticity is pressed as a strand from a nozzle. Subsequently, the wedges are cut in the required widths from said strand.

The non-positive connection of the layers 31, 32, 33, 34, 21, 22 with a lower and a higher modulus of elasticity of the wedge 3 or the anchor body 2 can be accomplished by gearing and/or adhesive bonding. The gear tooth system can be designed as illustrated in FIG. 12. However, intermeshing raised parts and dents, respectively, which are different from those illustrated in FIG. 12 are possible as well. In order to facilitate handling and improve the transmission of power, the gearing system can in addition be stuck together. The non-positive connection can be established already during manufacture, when the layer 21, 31 with a higher modulus of elasticity and the layer 22, 32, 33, 34 with a lower modulus of elasticity are cast together in a casing. If the connection of the layers 31, 32, 33, 34 and 21, 22, respectively, is subsequently accomplished via a bond, the contact surfaces should be roughened and free of grease. Especially low-viscosity adhesives which can also withstand high strains, such as, for example, the five-minute epoxide adhesive Hysol 3430 of Loctite, are perfectly suitable for adhesive bonding.

If the tensile elements 1 are anchored with wedges 3, the shear transmission between the tensile element 1 and the wedge 3 can be effected by friction, adhesive bonding and/or gearing. If the transmission is effected by friction, it is suitable to increase the same by roughening the contact surfaces or to use a friction material. A good friction material is, for example, a synthetic carbon fibre material, with the carbon fibres enclosing a right angle with the friction surface.

If the tensile element 1 and the wedge 3 are connected by adhesive bonding, epoxide resin adhesives such as Sikadur 30 of Messrs. SIKA or the fast-curing five-minute epoxide adhesive Hysol 3422 of Messrs. Loctite are suitable. The bonding can be improved by profiling similar to what is illustrated in FIG. 12 between the layers 21, 22 and 31, 32, respectively, with a lower and a higher modulus of elasticity. A short curing time of the adhesive is advantageous for the embodiment. The curing of adhesives based on epoxy resin can be accelerated by the supply of heat. For every 10° of heating, the curing time is reduced by roughly one half. Heating can be effected, for example, by a resistance wire in the wedge. Alternatively, the tensile element 1 can also be used instead of the resistance wire. If a current voltage is applied on both sides of the glue joint in the region near the load and in the region remote from the load and if an electric current flows, the tensile element 1 and hence also the adhesive heat up. The smaller the resistance, the higher the current conduction and hence also the heat produced. If an electrically conductive adhesive is used, the electrical contacts can also be installed in the region of the wedge 3 near the load and in the region remote from the load and are able to heat the adhesive by the application of a voltage.

The connection can also be established by profiling. In doing so, it is suitable if the profile is designed in a regular manner, for example in the cross-section, as a result of saw teeth or as a sine wave. On the wedges 3, the profile must be diametrically opposed to the profile of the tensile element 1 so that gearing becomes possible. When producing the tensile element 1, the profile can be pressed into the soft matrix material on both sides, using rolls. The profiling of the wedge 3 can be effected during casting by appropriate shaping in the casing.

The invention claimed is:

1. An anchorage for at least one pre-tensioned or stressed tensile element, the anchorage comprising:

one or more wedges each having a first region near a load and a second region remote from the load;

an anchor body, wherein a tensile force is transmittable to the anchor body by means of the one or more wedges; and wherein the one or more wedges have a wedge shape to slide along an inclined surface of the anchor body to force the one or more wedges against the at least one pre-tensioned or stressed tensile element, each of the one or more wedges comprising:

a first wedge-shaped layer in direct contact with a second wedge-shaped layer, the first wedge shaped layer located between the second wedge-shaped layer and the at least one pre-tensioned or stressed tensile element, the first wedge-shaped layer having a modulus of elasticity that is lower compared to the modulus of elasticity of the second wedge-shaped layer, wherein a greatest thickness of the first wedge-shaped layer, measured normal to the longitudinal axis of the tensile element, lies in the first region of the anchorage which is near the load, and a greatest thickness of the second wedge-shaped layer, measured normal to the longitudinal axis of the tensile element, lies in the second region of the anchorage which is remote from the load, wherein the first wedge-shaped layer lowers a stiffness of the one or more wedges in the first region near the load to more evenly distribute contact pressure on a contact area between the at least one pre-tensioned or stressed tensile element and the one or more wedges.

2. The anchorage according to claim 1, further characterized in that pores, holes notches or slots are arranged in the layer formed from the material having a lower modulus of elasticity to reduce the stiffness thereof in a direction normal to the longitudinal axis of the tensile element.

3. The anchorage according to claim 1, further characterized in that the different moduli of elasticity of the layers are caused during their manufacture by means of specific treatments including one of a heating process or a cooling process.

4. The anchorage according to claim 1, further characterized in that the layer formed from the material having a lower modulus of elasticity is connected to an adjacent layer having a higher modulus of elasticity via a non-positive connection.

5. The anchorage according to claim 4, wherein said non-positive connection comprises:

a profile with a counterprofile.

6. The anchorage according to claim 1, further characterized in that a transmission of shearing force between the wedge and the tensile element is ensured by a non-positive connection or by form closure.

7. The anchorage according to claim 6, wherein said non-positive connection or form closure comprises:

friction;

adhesive bonding; or the shaping of a profile.

8. The anchorage according to claim 1, further characterized in that the ratio of the lower modulus of elasticity to the higher modulus of elasticity is at least 1:2.

9. The anchorage according to claim 8, wherein the ratio is at least 1:10.

10. The anchorage according to claim 9, wherein the ratio is in a range from 1:20 to 1:30.

11. The anchorage according to claim 1, further characterized in that the wedge-shaped layer having a lower modulus of elasticity is formed by two likewise wedge-shaped partial layers with different moduli of elasticity.

12. An anchorage for at least one pre-tensioned or stressed tensile element, the anchorage comprising:

an anchor body and at least one wedge including;

a first wedge-shaped layer having a wedge shape and;

a second wedge-shaped layer in direct contact with the first wedge-shaped layer and having a wedge shape, the first and second wedge-shaped layers having a first region near a load and a second region remote from the load wherein said first wedge-shaped layer is located between the second wedge-shaped layer and the at least one pre-tensioned or stressed tensile element;

wherein a tensile force is transmittable to the anchor body by means of the first and second wedge shaped layers;

wherein the first and second wedge-shaped layers and the anchor body include an inclined surface to force the first and second wedge shaped layers against the at least one pre-tensioned or stressed tensile element, wherein the first wedge-shaped layer has a modulus of elasticity that is lower compared to the modulus of elasticity of the second wedge-shaped layer, wherein a greatest thickness of the first wedge-shaped layer, measured normal to the longitudinal axis of the tensile element, lies in the first region of the anchorage which is near the load and wherein a total thickness of the first and second wedge-shaped layers is smallest in the first region of the anchorage which is near the load to more evenly distribute contact pressure on a contact area between the at least one pre-tensioned or stressed tensile element and the first and second wedge-shaped layers.

13. The anchorage according to claim 12, wherein the first and second wedge-shaped layers form a wedge and the inclined surface is between the wedge and the anchor body.

14. The anchorage according to claim 12, wherein the first wedge-shaped layer is part of the anchor body and the inclined surface is formed between the first and second wedge shaped layers.

* * * * *